United States Patent [19]

Cosentino et al.

[11] 4,221,543

[45] Sep. 9, 1980

[54] BLOOM PUMP SYSTEM

[75] Inventors: Louis C. Cosentino, Wayzata; Bill H. Niemi, Brooklyn Park; John P. Silbernagel, Spring Lake Park; Jamshed R. Cooper, Golden Valley, all of Minn.

[73] Assignee: Renal Systems, Inc., Minneapolis, Minn.

[21] Appl. No.: 849,338

[22] Filed: Nov. 7, 1977

[51] Int. Cl.[3] ..... F04B 49/06; A61M 5/00

[52] U.S. Cl. ..... 417/22; 417/45

[58] Field of Search ..... 417/18, 22, 42, 44, 417/45; 128/218 E, DIG. 13

[56] References Cited

U.S. PATENT DOCUMENTS

| | | | |
|---|---|---|---|
| 3,855,515 | 12/1974 | Hutchins | 417/44 |
| 3,985,133 | 10/1976 | Jenkins et al. | 128/214 E |
| 4,024,864 | 5/1977 | Davies | 417/45 |
| 4,037,598 | 7/1977 | Georgi | 128/DIG. 13 |
| 4,108,575 | 8/1978 | Schal | 417/53 |
| 4,131,393 | 12/1978 | Magnussen | 417/22 |

*Primary Examiner*—William L. Freeh

*Attorney, Agent, or Firm*—Schroeder, Siegfried, Ryan, Vidas, Steffey & Arrett

[57] ABSTRACT

A blood pump system in which a roller pump is provided for pumping blood through a flexible tube. A low voltage D.C. motor is provided having an output shaft. An electrical control circuit is connected to the motor for applying the necessary voltage to drive the motor at a predetermined speed. Gearing means are provided connecting the motor's output shaft to drive the roller pump. Means are optically coupled to the motor for controlling the speed of the motor. Means are connected to the optically coupled means to determine the blood flow rate being pumped through the tube by the pump. Means are provided which display a digital readout of the flow rate. The roller pump is provided with an arcuate bearing surface, which carries the flexible tube, the bearing surface defining an arc of approximately 168°. Lead ramps extend from each end of the bearing surface and are substantially tangent to the end of the surface from which the respective ramp extends. Means are provided for allowing a variable rate of independently adjusting the radial deflection of each of the rollers of the roller pump. The system is also provided with isolation means for reducing leakage current and thus lowering the potential shock hazard to the patient from A.C. line voltage. Motor runaway and overspeed protection are also provided.

27 Claims, 11 Drawing Figures

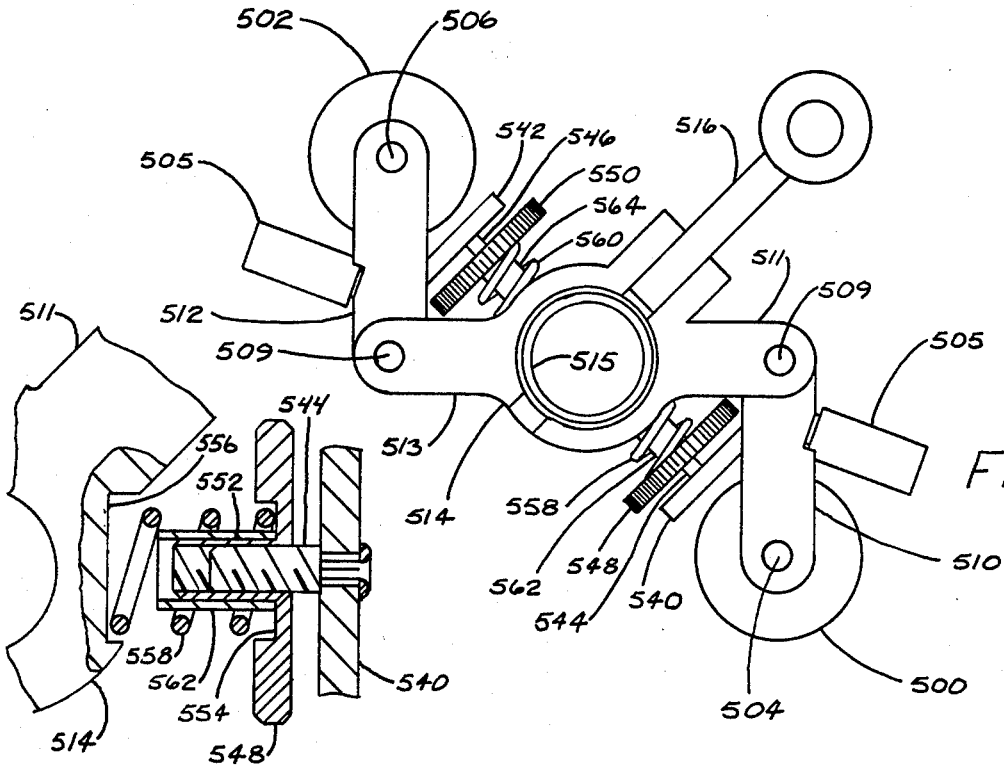
FIG. 9
FIG. 11
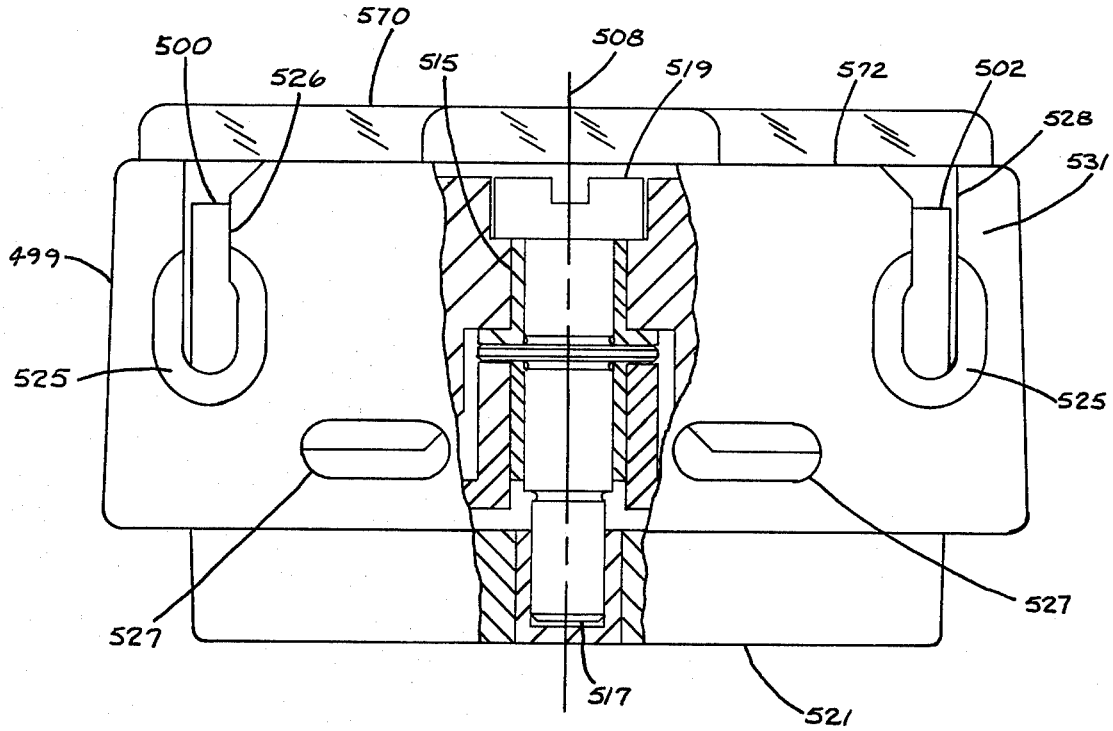
FIG. 8

BLOOM PUMP SYSTEM

BACKGROUND OF INVENTION

This invention relates to a blood pump system including a blood pump control system for driving a roller blood pump of the type used in hemodialysis systems.

Prior art blood pump systems used in hemodialysis systems have a number of operating disadvantages which it is the purpose of the present invention to overcome. One of the most important features of a blood pump system used in hemodialysis is precise regulation of the speed of the motor driving the blood pump. This is important because the precise regulation of blood flow can be critical for the patient from a physiological standpoint. Prior art systems do not provide as precise a regulation as desired. Along with this flow rate regulation it is necessary for the system's operator to know the exact flow rate. Systems currently available do not provide a direct digital readout of flow rate but merely provide an analog relative scale which the operator must correlate to blood flow rate. In order to protect against motor overload prior art systems use electromechanical circuit breakers to disable the motor. Such circuit breakers are relatively slow operating and are not particularly precise in terms of the level at which switching occurs. Another problem with many prior systems is that they use 110 volt motors which operate directly off line voltage. Such systems have a relatively high leakage current which creates a much greater shock hazard potential for the patient. Also many prior art systems do not utilize an optimal design configuration which allows for use of a much smaller motor by reducing the peak torque required for driving the pump. U.S. Pat. No. 3,787,148 is an example of a prior art blood pump which does not utilize the optimal design. This reference shows a pump having an arcuate bearing surface defining an arc of 177° and having lead ramps which diverge from the ends of the arcuate bearing surface by 10°. Such configuration does not allow for the optimal peak torque reduction for rotation of the rollers. In addition the 10° lead ramp divergence creates a somewhat abrupt change in the cross-sectional bore of the flexible tube through which the blood is pumped as the rollers approach and recede from the point of occlusion of the tube. Such change is also not desirable from the physiological viewpoint of the patient. Also prior art systems do not allow for a variable rate of independent adjustability of each of the rollers used in the roller pump or adjustment mechanism for adjusting the rollers which is located radially with respect to the main axis of rotation of the rotator head assembly.

The blood pump system of the present invention has the following features and advantages. Precise motor speed regulation is provided so that the blood flow rate of the blood pump can be accurately and precisely controlled for each individual patient. Another significant safety feature from the patients' viewpoint is that leakage current is greatly reduced thereby significantly lowering the potential shock hazard to the patient. The system also incorporates electronic circuit breakers which are much faster and precise in their level of switching. Motor overload and runaway protection circuitry is provided as further safety protection for the patient. By using a low voltage D.C. motor coupled with an isolation transformer as opposed to a 110 volt line operated motor, the efficiency of the system is maximized, as well as permitting a great reduction in the size and weight of the components used, especially with respect to the power transformer, the filter capacitor, the heatsinking required and the size of the motor used. A digital readout of the blood flow rate is provided so the operator need not make any extrapolations or correlations but has a direct digital readout. This feature also increases the safety of the system from the patients' viewpoint. The size of the components is also reduced by optimizing the peak torque reduction and optimizing the graduation of change in cross-section of the bore of the flexible tube used through which the blood is pumped by choosing the optimal design configuration for the arcuate bearing surface and lead ramps used in the roller pump used in the system.

SUMMARY OF INVENTION

The blood pump system of the present invention provides a roller pump for pumping blood through a flexible tube. A low voltage D.C. motor having an output shaft is provided. An electrical control circuit is connected to the motor for applying the necessary voltage for driving the motor at a predetermined speed. Gearing means are connected to the output shaft of the motor to drive the roller pump. Means are optically coupled to the motor for controlling the speed of the motor. Means are connected to the optically coupled means for determining the blood flow rate being pumped through the tube by the pump. Means are provided for visually displaying a digital readout of the flow rate.

In the roller blood pump of the present invention there is provided an arcuate bearing surface defining a arc of approximately 168° which is adapted to carry the flexible tube through which the blood is pumped. A pair of 180° spaced-apart pivotally-mounted rollers which travel in a circular path concentric with the bearing surface are provided to occlude the tube thereby pumping blood therethrough. Means are provided for moving the rollers around the circular path. Lead ramps extend from each end of the bearing surface, each of the ramps extending substantially tangent to the end of the surface from which the respective ramp extends whereby the 168° arc and the tangent ramps provide the optimal torque peak reduction for the motor to drive the pump and the optimal graduated change in cross-section of the bore of the tube as each of the rollers approach and recede from the points of occlusion of the tube. Means located radially with respect to the main axis of rotation of the rotator head assembly are also provided for variable rate of independently adjusting the extent to which each of the rollers occludes the tube.

In the control system for driving the blood pump of the present invention, there is provided means which rectifies an incoming A.C. line voltage to a D.C. voltage. A transformer transforms the D.C. voltage to a series of low voltage pulses which provides the necessary torque for driving the pump. Means are optically coupled to the output shaft of the motor for providing a frequency representative of the rotational output speed of the motor. A converter converts the frequency to a voltage and means are provided for generating an error signal representing the difference between the voltage representing the speed at which the motor is set and the output voltage of the converter. This error signal is used to control the duty cycle of the pulses supplied to the motor. Means are provided for determining and providing a digital display of the flow rate through the pump. The system is also provided with isolation means for reducing the leakage current and thus lowering the potential shock hazard to the patient from A.C. line voltage. Motor runaway and overspeed protection are also provided.

BRIEF DESCRIPTION OF THE DRAWINGS

FIG. 8 is a side elevational view, partly in section, of the pump shown in FIG. 7 with the cover closed and the rollers in the position shown in FIG. 10 and no tube positioned in the pump;

FIG. 9 is a view of the details of the rotator head assembly of the pump of the present invention as shown in FIG. 7;

FIG. 11 is a cutaway view of the adjusting mechanism for each roller of the roller pump of the present invention as shown in FIGS. 7 and 9.

DESCRIPTION OF THE INVENTION

Figure 1:
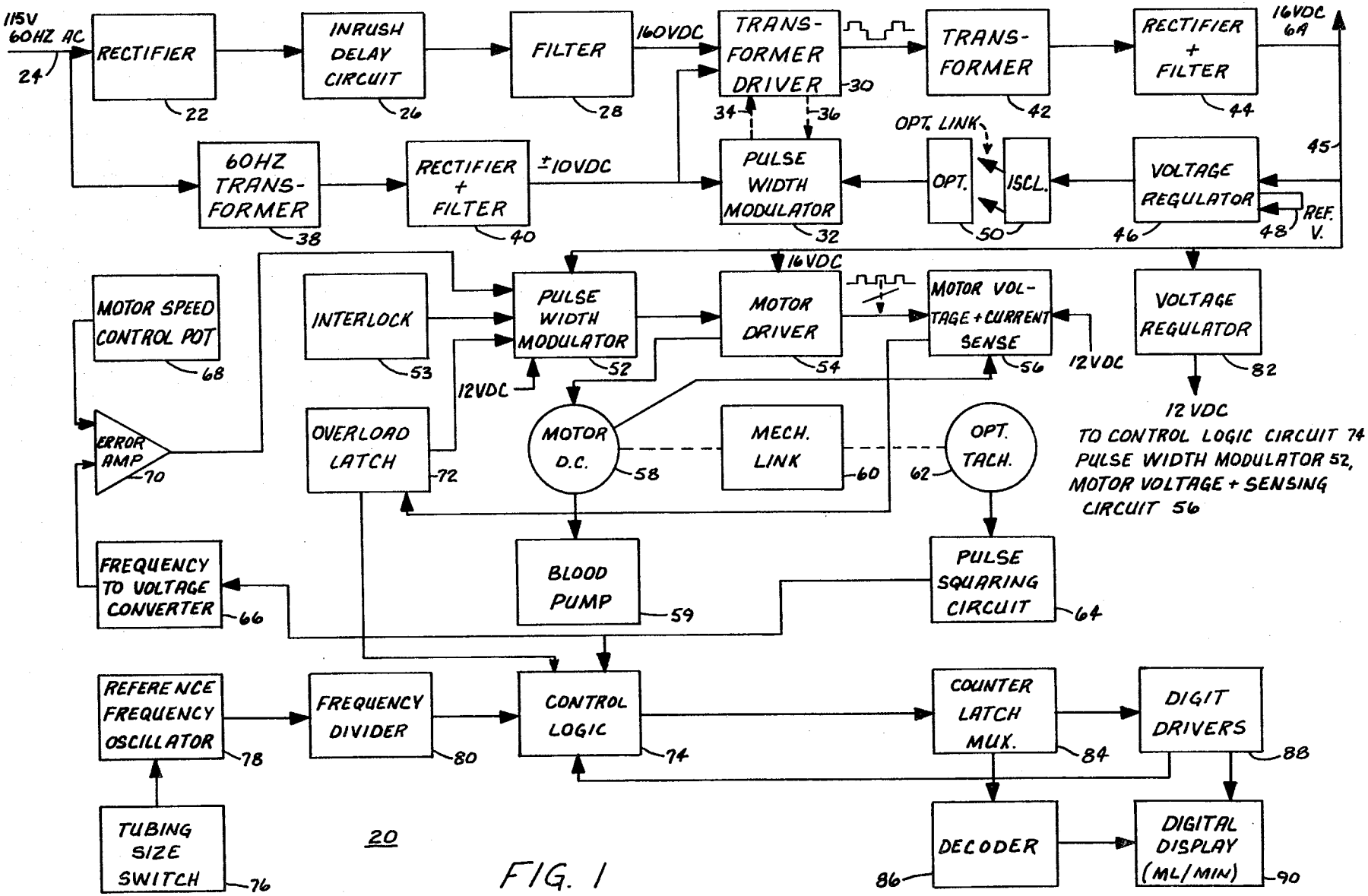
FIG. 1 is a diagrammatical illustration of the present invention.

FIG. 1 shows a block diagram of the blood pump system 20 of the present invention. In system 20 a rectifier 22, which may be a standard commercially available full wave bridge rectifier such as an MDA 922-5, is connected to a standard source of A.C. line current at 24 of 115 volts, 60 hertz. Connected to the output of rectifier 22 is an input delay circuit 26 whose output is connected to a filter 28. Circuit 26 and filter 28 are provided to reduce and delay the surge current. This serves to protect rectifier 22 and the system's on/off switch from excessive surge currents when power is first turned on.

With a line voltage at 115 volts A.C. the output of filter 28 is approximately 160 volts D.C. This 160 volt D.C. is applied to a push-pull transformer driver circuit 30 which switches the 160 volt D.C. signal on and off at a 20 kilohertz rate. The duty cycle of the pulses from transformer driver circuit 30 is controlled by a pulse width modulator 32 having a control input 34 connected to transformer driver circuit 30. A circuit sensing output 36 is provided from transformer driver circuit 30 to pulse width modulator 32. A ±10 volt D.C. low current signal is applied to both transformer driver circuit 30 and pulse width modulator 32. This ±10 volt D.C. signal is provided via a 60 hertz transformer 38 being connected to the line current at 24. The output of transformer 38 is rectified and filtered by rectifier and filter 40 to thus provide the ±10 volt D.C. signal.

The output of circuit 30 is connected to a transformer 42 which is a special transformer designed for 20 kilohertz pulsed operation. Transformer 42 reduces the voltage of the 160 volt pulses to 25 volt pulses which are then full-wave rectified and filtered by rectifier and filter 44 whose output is approximately a 16 volt D.C. signal on line 45. The 16 volt D.C. output from rectifier and filter 44 is applied to a voltage regulator 46 which compares this signal to an internal reference voltage provided at 48 to generate an error signal which is connected to drive an optically coupled isolator 50. The output of isolator 50 is connected to pulse width modulator 32. Isolator 50 is necessary to isolate all portions of the system on the secondary side of transformer 42 from the 60 hertz, 115 volt A.C. signal on the primary side of transformer 42. In this arrangement, pulse width modulator 32 generates a continuous 20 kilohertz pulse train with two outputs 180° out of phase to drive transformer driver circuit 30. An increase in error voltage from voltage regulator 46 causes a decrease in duty cycle and thus a decrease in D.C. output voltage in the 16 volt D.C. line 45. The duty cycle is also decreased when the primary pulse current exceeds a preset value.

The 16 volt D.C. output on line 45 is also applied to another pulse width modulator 52 and to a motor driver circuit 54. Also connected to pulse width modulator 52 is an interlock circuit 53. Interlock lock circuit 53 includes a magnetic switch activated by the cover 570 on the front of the blood pump (shown in FIG. 7). When this cover is opened the switch is opened thereby disabling the operation of the system. Wher the cover is closed, the switch closes, reactivating the system. The output of motor driver circuit 54 is connected to both a motor current and voltage sensing circuit 56 and a low voltage D.C. motor 58 (a motor operating on a voltage of less than 20 volts). The electrical output of motor 58 is connected to motor voltage and current sensing circuit 56. The output shaft of motor 58 drives a blood pump 59, the details of which are shown in FIGS. 7–11. The output shaft also has a mechanical link 60 in the form of a wheel containing many slots mounted thereon. An optical tachometer 62 is provided with a photo interrupter as an input. The wheel on the motor shaft rotates between an infra-red light source and light detector which form part of optical tachometer 62. Output pulses are generated by tachometer 62 at a rate equal to the number of slots on the wheel times the input speed in revolutions per second. This output from tachometer 62 is applied to a pulse squaring circuit 64 for shaping the pulses. The output of pulse squaring circuit 64 is connected to a frequency-to-voltage converter 66 which converts the frequency of the pulses from pulse squaring circuit 64 into a corresponding voltage. This voltage together with a voltage determined by the setting of the motor speed control potentiometer 68 are applied to an error amplifier 70. Error amplifier 70 generates an error signal which represents the difference in level between the voltage at which the motor speed control potentiometer 68 is set and the voltage output from the frequency-to-voltage converter 66. This error signal from error amplifier 70 is used to drive pulse width modulator 52 whose output is connected to motor driver circuit 54. Thus pulse width modulation is used to control motor speed. As the error signal from error amplifier 70 increases, the duty cycle of the pulses supplied to motor 58 increases.

In order to protect the motor 58 from a voltage or current overload condition and to prevent motor runaway, an overload latching circuit 72 is provided. Overload latching circuit 72 is connected to the output of motor voltage and current sensing circuit 56. The output of latching circuit 72 is connected to pulse width modulator 52 so that when a voltage or current overload condition is sensed by sensing circuit 56, latching circuit 72 applies a signal to pulse width modulator 52 whose output causes motor driver circuit 54 to disable motor 58 until a power-on clearing cycle occurs and the overload condition is no longer sensed.

In order to provide flow rate readout of the blood flow through the blood lines being pumped by blood pump 59, the output pulses from pulse squaring circuit 64 are connected to control logic circuitry 74. The overload latching circuit 72 is also connected to control logic circuitry 74. A tubing size switch 76 is provided on the control panel of the system for setting a reference frequency oscillator 78 whose output is determined by the inner diameter of the blood tubing being used through which the blood is being pumped. The output of oscillator 78 is connected to a frequency divider 80 whose output is connected to control logic circuitry 74. Also applied to control logic circuitry 74 is a low level input voltage (approximately 12 volts D.C.) provided by a standard commercially available voltage regulator 82, which may be an LM341P. Input to voltage regulator 82 is the 16 volt D.C. voltage from line 45. Control logic circuitry 74 gates the pulses from pulse squaring circuit 64 to a counter, latching and multiplex circuit 84. Circuit 84 counts the pulses from control logic circuitry 74 for a preset time, at which time the counter stops, and the total count is stored in a latch and multiplexed. The multiplexed count is then decoded by a BCD to seven segment decoder 86 and also applied to digit drivers 88. The outputs of decoder 86 and digit drivers 88 are applied to a digital display 90 which provides a digital readout of the rate of flow of blood through the blood lines being pumped by the blood pump 59. The flow rate readout of display 90 is some constant of proportionality times the motor speed and gives the operator a direct readout of the number of milliliters per minute of blood being pumped.

Figures 2, 3:
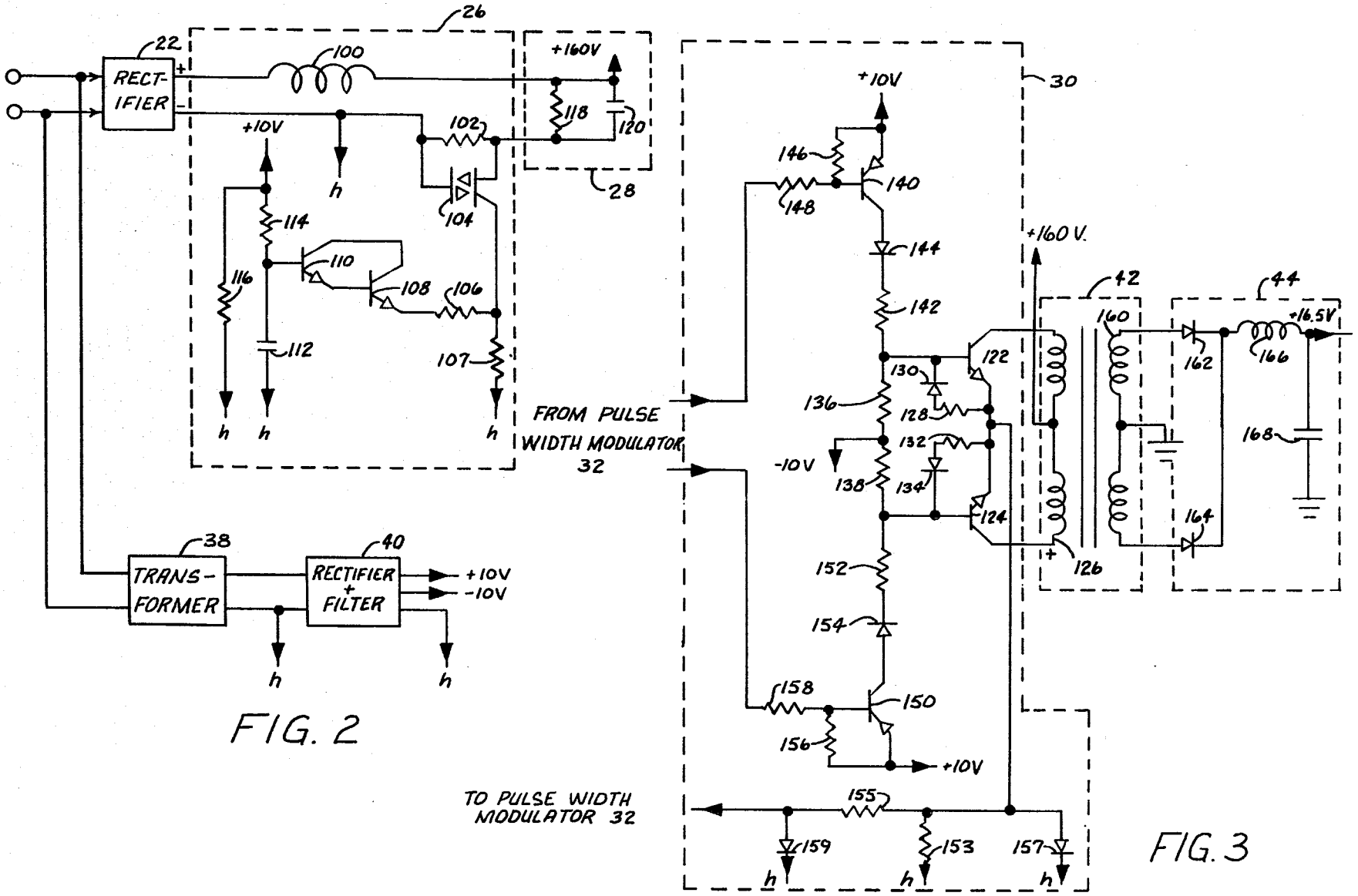
FIGS. 2–6 are more detailed circuit diagrams of the electronic components comprising the invention shown in FIG. 1.
Figure 4:
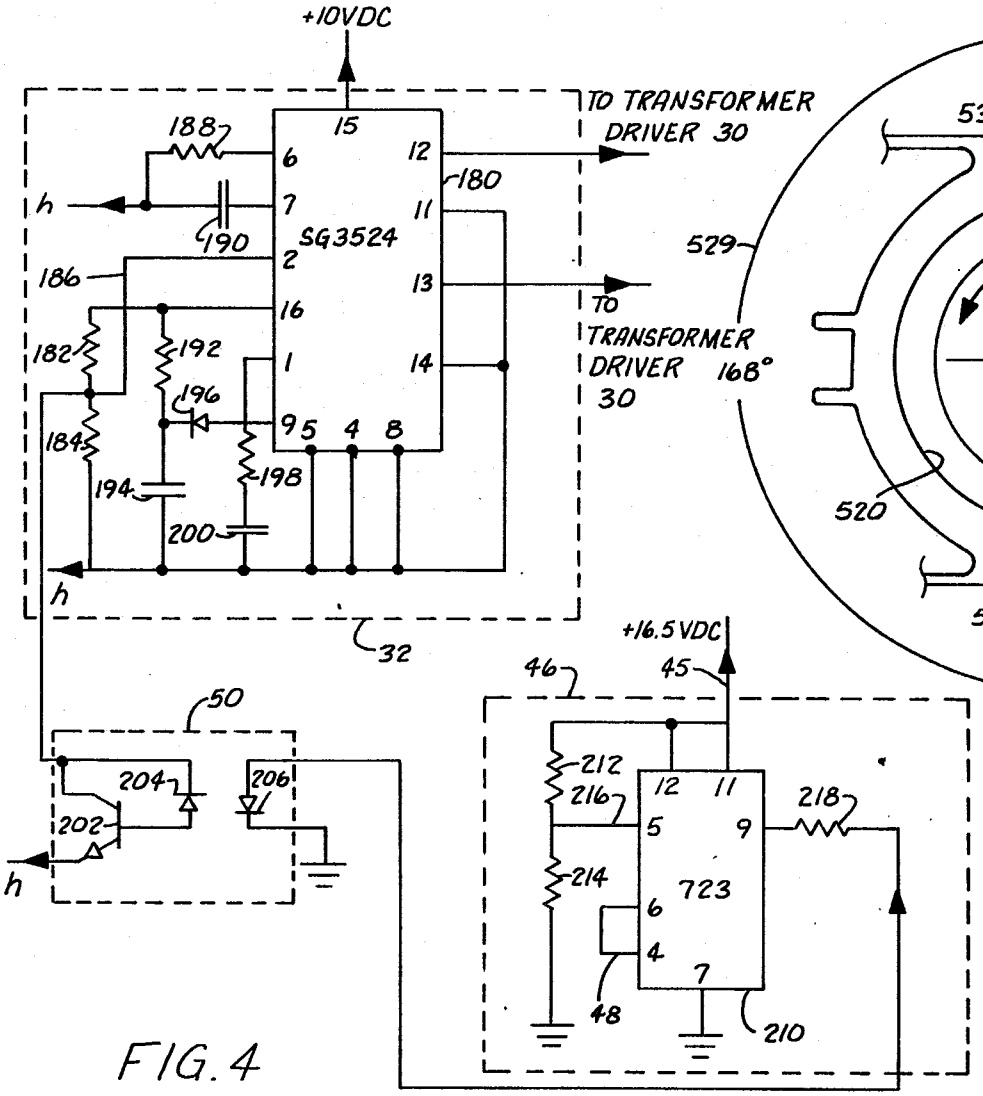

A more detailed description of the circuitry of a number of the components, as well as their operation, shown in FIG. 1 will now be provided. The connections to the symbol "h" in FIGS. 2, 3, and 4 are used to designate connection to ground on the primary side of transformer 42 which is different from the other ground connections shown in the various figures. As seen in FIG. 2 delay circuit 26 has an inductor 100 connected to the positive terminal output of rectifier 22. Connected to the negative terminal of rectifier 22 is a resistor 102 across which is connected a triac 104. Connected to one terminal of triac 104 via a voltage divider provided by resistors 106 and 107 is a darlington emitter-follower arrangement comprising transistors 108 and 110. Connected to the base of transistor 110 is a capacitor 112 and charging and discharge paths for capacitor 112 provided by resistors 114 and 116 respectively. Filter 28 comprises a parallel-connected resistor 118 and capacitor 120 which are together connected across inductor 100 and triac 104.

In operation, when power is applied, capacitor 112 begins to charge through resistor 114. At the same time, capacitor 120 begins to charge through resistor 102. Transistors 108 and 110 form a Darlington emitter-follower with low input current to minimize the loading on capacitor 112. The emitter voltage of transistor 108 begins to rise exponentially until the gate voltage at triac 104 reaches its threshold and fires, thus shorting resistor 102 and placing capacitor 120 directly across the 160 volt line. Without inrush delay circuit 26, input surge currents will exceed 20 amps but with circuit 26 the surge current is reduced to less than 3 amps. When power is removed resistor 116 provides a discharge path for capacitor 112 and resistor 118 serves as a bleeder resistor to discharge capacitor 120. The voltage divider provided by resistors 106 and 107 serves to limit the maximum gate voltage applied to triac 104. Resistor 118 and capacitor 120 forming filter 28 serve to reduce the 120 hertz ripple present on the incoming line. Inductor 100 reduces the rate of change of voltage across triac 104 to prevent it from firing before its gate voltage reaches threshold. FIG. 3 shows the details of the circuitry comprising transformer driver circuit 30, transformer 42 and rectifier and filter 44. Transformer driver circuit 30 comprises a pair of push-pull transistors 122 and 124 connected to center—tapped primary 126 of isolation transformer 42. Connected between the emitter and base of transistor 122 is a resistor 128 and a diode 130. Connected between the emitter and base of transistor 124 is a resistor 132 and a diode 134. A pair of resistors 136 and 138 are connected between the bases of transistors 122 and 124. The second half of the transformer driver circuit is identical to the first half. The collector of a transistor 140 is connected to the base of transistor 122 via a resistor 142 and diode 144. A resistor 146 is connected between the emitter and base of transistor 140. Connected between the output of pulse width modulator 32 and base of transistor 140 is a resistor 148. The collector of a transistor 150 is connected to the base of transistor 124 via a resistor 152 and diode 154. A resistor 156 is connected between the emitter and base of transistor 150. Connected between the output of pulse width modulator 32 and base of transistor 150 is a resistor 158.

Connected to the emitters of transistor 122 and 124 is a resistor 153. A resistor 155 is connected between resistor 153 and the pulse width modulator 32. Diodes 157 and 159 are connected to resistors 153 and 155 respectively.

Transformer 42 has a center-tapped secondary 160 to each end of which is connected diode rectifiers 162 and 164 which form a full-wave center-tapped rectifier. An inductor 166 is connected to both diodes 162 and 164. A capacitor 168 is connected between inductor 166 and ground. Inductor 166 and capacitor 168 form a filter.

In operation when transistor 122 is on, transistor 124 is always off and when transistor 124 is on, transistor 122 is always off. Both transistors 122 and 124 may be off simultaneously. When transistor 122 is on, transistor 140 provides the necessary voltage to drive the base of transistor 122 through diode 144 and resistor 142. Diode 144 prevents excessive voltages from reaching transistor 140 in the event that transistor 122 fails in a shorted collector-to-base condition. Resistor 142 limits the base drive to transistor 122. Resistor 148 limits the "ON" base drive to transistor 140. When transistor 122 is off, "OFF" base drive current is provided to transistor 122 through resistor 136. Resistors 128 and 136 form a voltage divider to limit the maximum reverse base-emitter voltage. Diode 130 prevents loss of some "ON" base drive current through resistor 128. Resistor 146 is a bias resistor that establishes the base of transistor 140 at the same potential as the emitter of transistor 140 in the "OFF" state. Similarly when transistor 124 is on, transistor 150 provides the necessary voltage to drive the base of transistor 124 through diode 154 and resistor 152. Diode 154 prevents excessive voltages from reaching transistor 150 in the event that transistor 124 fails in a shorted collector-to-base condition. Resistor 152 limits the base drive to transistor 124. Resistor 158 limits the "ON" base drive to transistor 150. When transistor 124 is off, "OFF" base drive current is provided to transistor 124 through resistor 138. Diode 134 prevents loss of some "ON" base drive current through resistor 132. Resistor 156 is a bias resistor that establishes the base of transistor 150 at the same potential as the emitter of transistor 150 in the "OFF" state.

Resistor 153 provides current sensing by carrying the current from the emitters of both transistors 122 and 124. This sense voltage provided by resistor 153 proportional to current is fed via resistor 155 to pulse width modulator 32. Resistor 155 provides current limiting to diode 159 in the event the voltage across resistor 153 becomes excessive. Diode 157 further prevents excessive voltage across resistor 153 in the event of transistors 122 or 124 shorting.

Diodes 162 and 164 of rectifier and filter 44 form a full-wave center-tapped rectifier. Both diodes are high speed rectifier diodes to minimize power losses in switching. Inductor 166 minimizes the peak-to-average current ratio required through transistors 122 and 124 and diodes 162 and 164. Capacitor 168 serves to reduce the 40 kilohertz ripple which is present in the incoming signal. FIG. 4 shows the circuit details of the pulse width modulator 32, the voltage regulator 46 and the optical isolator 50. The primary component of pulse width modulator 32 may be a commercially available integrated circuit (IC) such as SG 3524 represented by block 180. IC 180 generates a continuous train of pulses 180° out of phase. A voltage divider is provided by resistors 182 and 184 which are connected to pins 16 and 5 of IC 180 repsectively. A connection 186 is made from pin 2 of IC 180 between resistors 182 and 184. This voltage divider limits the maximum control voltage at pin 2. The control voltage at pin 2 determines the duty cycle of the pulses generated at the output of pins 12 and 13 which are connected to transformer driver circuit 30. Duty cycle increases with increasing voltage at pin 2. An error amplifier within IC 180 is connected as a voltage follower, thus pins 1 and 9 follow the voltage at pin 2. A resistor 188 is connected to pin 6 and a capacitor 190 is connected to pin 7 of IC 180. Resistor 188 and capacitor 190 determine the frequency of the output pulses on pins 12 and 13. A resistor 192 and a capacitor 194 are connected to pin 16. A diode 196 is connected from pins 1 and 9 to the connection between resistor 192 and capacitor 194. Resistor 192 and capacitor 194 are part of a slow-start circuit which holds pins 1 and 9 voltage low when power is first applied via the diode 196. Diode 196 prevents the voltage across capacitor 194 from interferring with normal regulator operation when the voltage across capacitor 194 exceeds the voltage at pins 1 and 9. A resistor 198 and capacitor 200 are connected in series to pins 1 and 9 and form a filter to prevent instability and resultant high frequency oscillations at the 16 volt D.C. output line 45.

Resistor 153 of transformer driver circuit 30 senses the emitter currents from transistors 122 and 124 and voltage from resistor 153 is fed back to pin 4 which is the current sensing pin of IC 180 of pulse width modulator 32. The method of current limiting employed herein provides protection to the circuit components on a pulse for pulse basis and is more effective than sensing at the output of the supply. An imbalance in the transformer primary 126, for instance, which could saturate transformer 42 would be protected against.

Optical isolator 50 comprises a transistor 202 whose collector is connected to the voltage divider formed by resistors 182 and 184 of pulse width modulator 32. A photo diode 204 is connected between the base and collector of transistor 202. A second photo diode 206 is connected between ground and a terminal of voltage regulator 46. Optical isolator 50 provides the isolation between primary 126 and secondary 160 of transformer 42. When power is first applied the collector of transistor 202 goes to its maximum level. Only when the 16 volt D.C. output on line 45 approaches nominal setpoint does the collector voltage begin to drop as a result of feedback being applied to transistor 202 via an increase in drive current to light emitting diode 206. Isolator 50 may be a commercially available IC circuit such as 5082-4351.

Voltage regulator 46 may be a commercially available IC circuit such as 723 represented by block 210. A pair of resistors 212 and 214, which form a voltage divider, are connected from pins 11 and 12 of IC 210 to ground. A connection 216 is provided from pin 5 of IC 210 to the connection between resistors 212 and 214. The internal reference voltage connection 48 is provided between pins 4 and 6. A resistor 218 is connected between pin 9 of IC 210 and diode 206 of optical isolator 50. Voltage regulator 46 serves to regulate the 16 volt D.C. on line 45. The voltage divider formed by resistors 212 and 214 divides the supply voltage on line 45 down to equal the internal reference voltage at pin 6. Since the reference voltage is connected to the inverting input and the 16 volt D.C. output voltage on line 45 is connected to the non-inverting input of IC 210, an increase in the 16 volt D.C. output on line 45 causes an increase in the voltage at pin 9, which increases the feedback signal to optical isolator 50 which in turn causes the pulse width modulator 32 to lower the 16 volt D.C. output level.

Figure 5:
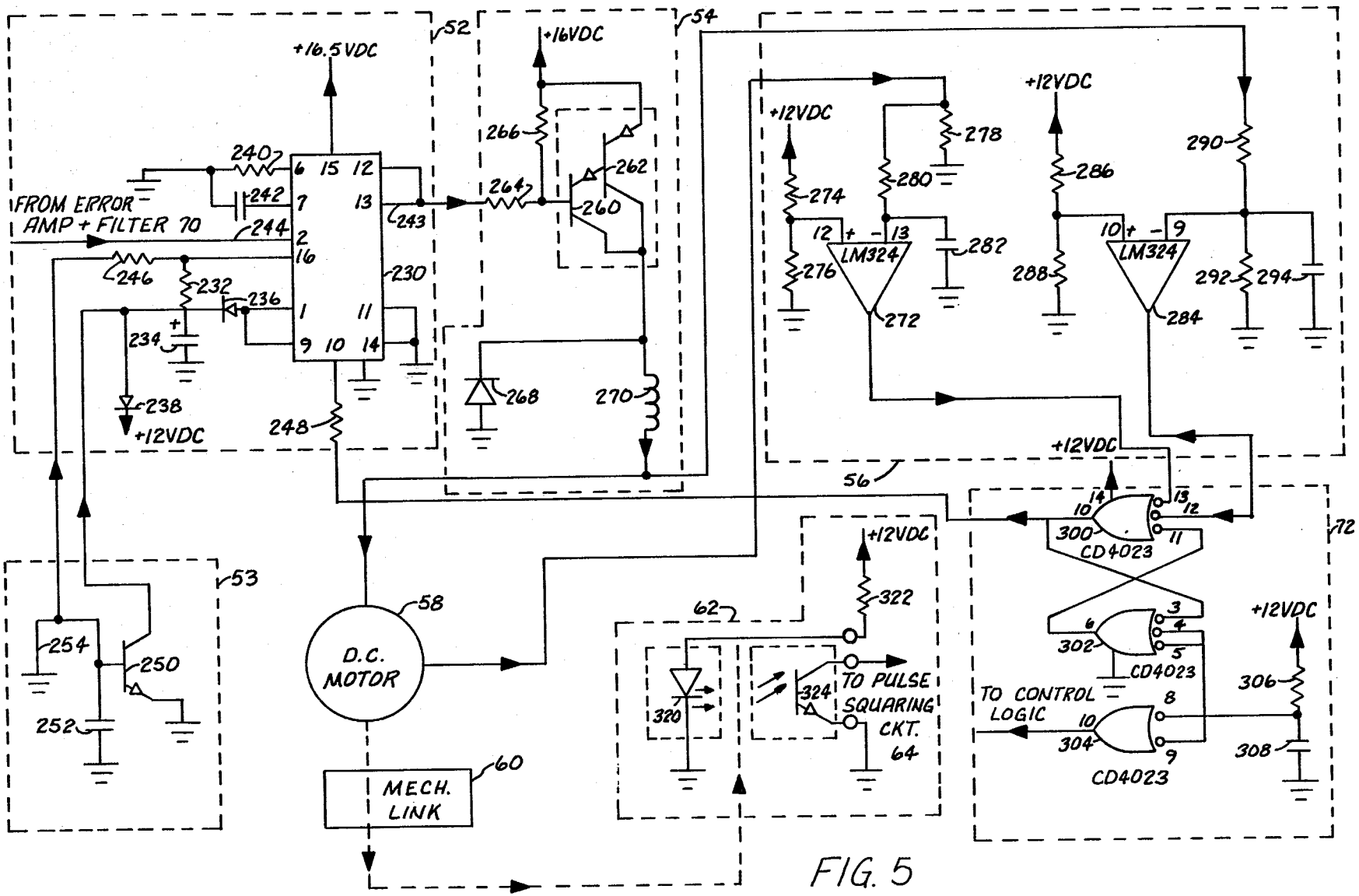

FIG. 5 shows the details of the circuitry comprising pulse width modulator 52, interlock circuit 53, motor driver circuit 54 motor voltage and current sensing circuit 56, optical tachometer 62 and overload latching circuit 72. Pulse width modulator 52 may be a standard commercially available IC circuit such as SG3524 represented by block 230. A resistor 232 and capacitor 234 are connected between pin 16 of IC 230 and ground. A diode 236 is connected to pins 1 and 9 of IC 230 and to the connection between resistor 232 and capacitor 234. Resistor 232 and capacitor 234 form an RC delay for a slow start effect by allowing the voltage at pin 9 to rise gradually through diode 236. Diode 236 prevents the voltage across capacitor 234 from interfering with normal regulator action when capacitor 234 is completely charged. Another diode 238 is connected between the connection between resistor 232 and capacitor 234 and the 12 volt D.C. supply from voltage regulator 82. Diode 238 allows capacitor 234 to discharge rapidly when power is removed thus ensuring a slow start from zero when power is reapplied. A resistor 240 is connected between pin 6 of IC 230 and ground and capacitor 242 is connected between pin 7 and ground. Resistor 240 and capacitor 242 determine the frequency of the pulses on line 243 connected to pins 12 and 13 which are connected to motor driver circuit 54. The error amplifier within IC 230 is connected as a voltage follower so that pins 1 and 9 follow the voltage at pin 2 of IC 230. Pin 2 is connected on line 244 to the error amplifier and filter 70. Connected between resistor 232 and interlock circuit 53 is a resistor 246. A resistor 248 is connected between pin 10 of IC 230 and the overload latching circuit 72 as shown in FIG. 5.

Interlock circuit 53 comprises a transistor 250 whose emitter is connected to ground. The collector of transistor 250 is connected to diode 238 of pulse width modulator 52. A capacitor 252 is connected between the base of transistor 250 and ground. The base of transistor 250 is also connected to resistor 246 of pulse width modulator 52 as well as to a magnetic switch 254 which is located in the cover of blood pump 59 (see FIG. 7) which is controlled by the control system of the present invention. In operation switch 254 is normally closed. When switch 254 is opened by opening the external cover on the blood pump mechanism, transistor 250 drives capacitor 234 of pulse width modulator 52 to a low level, thus disabling motor 58 via the signal sent on line 243 to the motor driver circuit 54. Resistor 246 provides "ON" base drive to transistor 250 when switch 254 is opened. Capacitor 252 is a bypass capacitor which prevents noise from triggering transistor 250.

Motor driver circuit 54 includes a pair of transistors 260 and 262 arranged in a Darlington emitter—follower configuration. A resistor 264 is connected between the base of transistor 260 and line 243 from pulse width modulator 52. A resistor 266 is connected between the base of transistor 260 and the emitter of transistor 262. Connected to the collectors of transistors 260 and 262 from ground is a diode 268. An inductor 270 is connected from the collectors of transistors 260 and 262 to motor 58. Inductor 270 serves to limit the peak-to-average current ratio demanded by transistor 262 and smooths the motor armature current. Diode 268 provides current through inductor 270 when transistor 262 is off and prevents excessive collector-emitter voltage at transistor 262. Resistor 264 limits the "ON" base drive to transistor 260 while resistor 266 provides an "OFF" bias voltage level to the base of transistor 260. Inductor 270 and diode 268 serve to limit the peak-to-average current to motor 58 to minimize stress on the output of transistor 262 and the motor brushes by allowing current to continue flowing through motor 58 when transistor 262 is off between pulses.

Motor voltage and current sensing circuit 56 comprises an over-current sensing circuit and an over-voltage sensing circuit. The over-current sensing circuit includes a comparator 272 which may be a standard commercially available operational amplifier such as an LM324. Connected to input pin 12 of comparator 272 is a voltage divider consisting of resistors 274 and 276 which establish a reference voltage at pin 12. A sensing resistor 278 is provided between motor 58 and a resistor 280 which is connected to inverting input pin 13 of comparator 272. A capacitor 282 is connected between pin 13 and ground. Voltage from resistor 278 is fed via resistor 280 to pin 13. Resistor 280 and capacitor 282 form a low pass filter to remove high frequency pulses from the sensed current waveform. When the voltage at pin 13 exceeds the voltage of pin 12, the output of comparator 272 goes low to set the overload latching circuit 72 which provides a signal on line to pulse width modulator 52 to cause motor driver circuit 54 to disable motor 58.

The motor over-voltage circuit of sensing circuit 56 includes another comparator 284, which may be a standard commercially available operational amplifier such as an LM 324 connected for voltage sensing. Connected to input pin 10 of comparator 284 is a voltage divider consisting of resistors 286 and 288 which establish a reference voltage at pin 10 of comparator 284. Another voltage divider consisting of resistors 290 and 292 is connected to inverting input pin 9 of comparator 284. Resistor 290 is connected to inductor 270 of motor driver circuit 54. Also connected between pin 9 and ground is a capacitor 294. Resistors 290 and 292 scale the motor voltage which is applied to pin 9 and resistors 290 and 292 and capacitor 294 form a low pass filter to remove high-frequency pulses from the voltage waveform. When the voltage of pin 9 exceeds the voltage input at pin 10, the output of comparator 284 goes to a low state thereby setting overload latching circuit 72 which causes motor 58 to be disabled. This over-voltage sensing provides a certain degree of overspeed protection in the event of loss of tachometer signal or other component failures.

The overload latching circuit 72 includes a pair of three input NAND gates 300 and 302 connected to the outputs of sensing circuit 56 as shown. The output of gate 300 is connected to pin 10 of IC 230 of pulse width modulator 52 via resistor 248. Another gate 304 is connected to pins 4 and 5 of gate 302. Connected to input pins 8 and 9 of gate 304 is an RC combination of resistor 306 and capacitor 308. The output of gate 304 is connected to control logic circuitry 74 to provide a signal to the control circuitry when the motor is being disabled. In operation when either input, pin 12 or 13 of gate 300 goes low, the overload latching circuit 72 is set and disables the output of pulse width modulator 52 by placing a high level at the shut-down input at pin 10 of IC 230. Latching circuit 72 is always reset by turning power off through the action of resistor 306 and capacitor 308. When power is off, capacitor 308 discharges through resistor 306 and when power is restored, capacitor 308 begins to charge through resistor 306. The time constant provided by capacitor 308 and resistor 306 determines the length of the low level "clear" pulse which is applied to gate 302 at pins 4 and 5.

Optical tachometer 62 comprises a photo interrupter module which is made up of a light emitting diode (LED) 320 connected to a resistor 322. LED 320 and photo transistor 324 may be a standard commercially available module such as a GE H13Al. The multi-slotted wheel of mechanical link 60 is mounted on the output shaft of motor 58 and rotates between the infrared light source provided by LED 320 and a light detector in the form of a photo transistor 324. The output of transistor 324 is connected to the input of pulse squaring circuit 64. Output pulses from transistor 324 are generated at a rate equal to the number of slots on the wheel times the input speed in revolutions per second.

Figure 6:
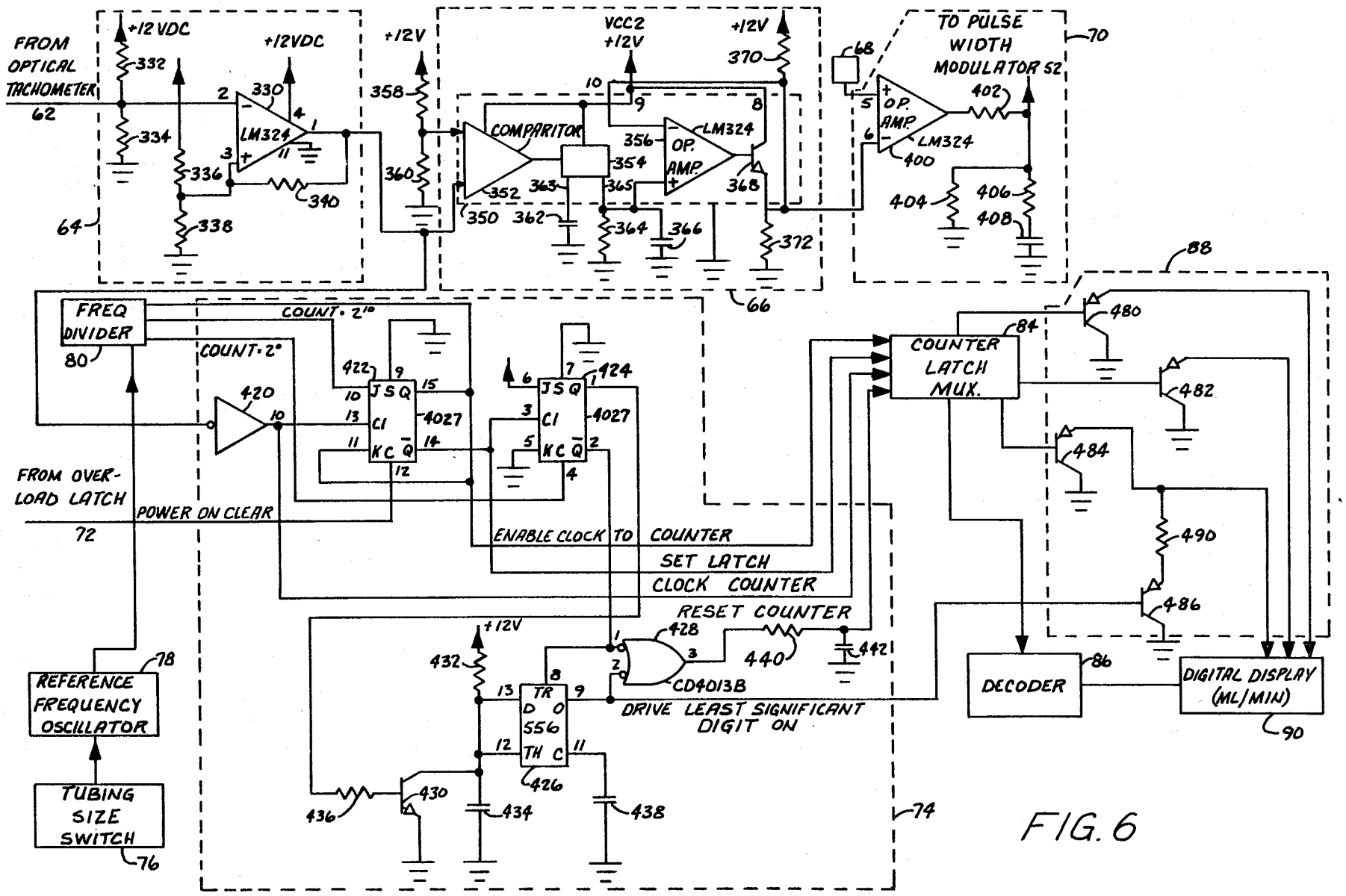

FIG. 6 shows more detailed circuitry of the remaining components of the control system of the present invention shown in FIG. 1 and, in particular, of pulse squaring circuit 64, error amplifier 70, control logic 74 and digit drivers 88. Pulse squaring circuit 64 includes a comparator which may be a standard commercially available operational amplifier such as an LM 324. Connected to one input of comparator 330 is a voltage divider comprising resistors 332 and 334. A second voltage divider comprising resistors 336 and 338 is connected to the non-inverting input of comparator 330. A resistor 340 is connected between the non-inverting input and the output of comparator 330. The voltage divider provided by resistors 332 and 334 serves to attenuate the voltage from optical tachometer 62 to be compatible with the common mode voltage range of comparator 330. The voltage divider formed by resistors 336 and 338 provide a reference voltage to the non-inverting input of comparator 330. Resistor 340 provides hysteresis to increase noise immunity and prevent noise on the output pulse. Since the output amplitude of optical tachometer 62 decreases with increasing RPM of the output shaft of motor 58, the switching reference point at the non-inverting input of comparator 330 was chosen sufficiently low to insure proper triggering at the highest RPM attainable. Comparator 330 shapes the pulses from photo transistor 324 of optical tachometer 62 and provides a Schmitt trigger effect to prevent noise pulses from being generated as its input signal passes through threshold. The output of pulse squaring circuit 64 is connected to the frequency-to-voltage converter 66, as well as to the control logic circuit 74.

Frequency-to-voltage converter 66 includes an integrated circuit IC 350, which may be a standard commercially available integrated circuit such as an LM 2907N. IC 350 includes a comparator 352 whose output is connected to a charge source 354 and another comparator 356 connected to comparator 352 and charge source 354. A voltage divider comprising resistors 358 and 360 is connected to one input of comparator 352 to provide a reference voltage. The other input of comparator 352 has applied thereto the output pulses from pulse squaring circuit 64. Each time the voltage of these pulses exceeds or falls below the reference voltage provided by the voltage divider comprising resistors 358 and 360, comparator 352 changes state. Each time comparator 352 changes state a constant charge source 354 provides a constant charge into or out of a capacitor 362 connected thereto at terminal 363. Also connected to charge source 354 at terminal 365 is an RC combination made up of resistor 364 and capacitor 366 which are also connected as shown to an input of operational amplifier 356. The output at terminal 365 of charge source 354 to which resistor 364 and capacitor 366 are connected mirrors the average current from terminal 363 of source 354 to which capacitor 362 is connected and the average voltage at terminal 365 is the product of Vcc times the frequency of the pulses from pulse squaring circuit 64 times the time constant provided by capacitor 362 and resistor 364. Capacitor 366 serves to average the voltage at terminal 365 and removes most of the ripple otherwise present on terminal 365. Connected to the output of operational amplifier 356 is the base of a transistor 368 with the collector thereof being connected to comparator 352 and charge source 354. The emitter of transistor 368 is connected to the other input of comparator 356 as well as to one input of error amplifier 70. Resistors 370 and 372 are connected to the emitter of transistor 368 as shown. Comparator 356 and transistor 368 are connected in a voltage follower configuration such that the output Vo of frequency-to-voltage converter 66 is the same as the voltage at terminal 365 for all but very low or zero input frequencies. When the input frequency of the pulses from squaring circuit 64 drops to zero, the voltage at terminal 365 becomes zero and the output voltage Vo would drop to zero if it were not for resistor 370. Resistor 370 adds a slight offset to Vo at zero input frequency to insure that the output of the error amplifier 70 remains low when the speed control potentiometer 68 is set at its minimum setting. Thus, it is insured that the motor 58 will remain stopped when the potentiometer 68 is set at minimum.

Motor speed control potentiometer 68, which may be anyone of a number of standard commercially available potentiometers, and the output of frequency-to-voltage converter 66 are connected to separate inputs of an operational amplifier 400 which forms a part of error amplifier 70. Comparator 400 may be a standard commercially available operational amplifier such as an LM 324. Connected to the output of the operational amplifier is a filter network including a resistor 402, a resistor 404 connected from resistor 402 to ground and an RC combination of resistor 406 and capacitor 408 connected from resistor 402 to ground. Operational amplifier 400 amplifies the difference between the speed set point voltage supplied from potentiometer 68 at pin 5 and the error voltage generated by frequency-to-voltage converter 66 applied at pin 6. The filter network provides stability to the control system and prevents motor speed "hunting".

Tubing size switch 76 is a switch provided on the front control panel of blood pump 59 which is used by the operator in selecting the correct internal resistance to correspond with blood tubing size (inner diameter) being used. The internal circuitry simply consists of a group of resistors each having a resistance value selected to correspond to a particular size tubing. The switch on the panel is set to the tubing size being used and the correct resistance value is thus automatically selected. The resistor so selected is connected appropriately to reference frequency oscillator 78, which may be a standard commercially available astable multivibrator such as number 556. The output of oscillator 78 is connected to frequency divider 80, which may be a standard commercially available frequency divider such as a number CD4040. The output of divider 80 is appropriately connected to control logic circuit 74. Also connected to control logic circuit 74 is the output from pulse squaring circuit 64 and the output from gate 304 of overload latching circuit 72.

Control logic circuit 74 includes several standard commercially available integrated circuits. These circuits include an inverter 420, such as a CD4093B, a pair of IC's 422 and 424 such as number 4027's, monostable multivibrator 426 such as a number 556, and a nand gate 428 such as a CD4093B. A transistor 430 has its collector connected to two terminals of monostable multivibrator 426. Also connected to the collector of transistor 430 are a resistor 432 and a capacitor 434. Connected between the base of transistor 430 and one terinal of IC 424 is a resistor 436. A capacitor 438 is connected between a terminal of oscillator 426 and ground. Connected to the output of gate 428 is a filter comprising resistor 440 and capacitor 442.

In the operation of control logic circuit 74 inverter 420 inverts tachometer pulses from pulse squaring circuit 64. When the count from the frequency divider 80 reaches $2^{10}$, IC422 is set (placing the Q output high) on a rising edge of the clock signal from inverter 420 (the inverted tachometer pulses from the pulse squaring circuit 64). When IC 422 sets, the input clock to the counter of circuit 84 is disabled, preventing further counter advance. Also, the latch in the circuit 84 is enabled, allowing the final value of the display counter to be gated to the latch. At the same time, the counter in frequency divider 80 is cleared to allow a new timing cycle to start. With the next tachometer pulse, the clock input to IC422 goes low, and when it again goes high, IC422 is cleared, placing the $\overline{Q}$ output of IC 422 high and causing IC 424 to set. The $\overline{Q}$ output of IC 422 then goes low, causing the output of gate 428 to go high, which in turn resets the counter of circuit 84. Resistor 440 and capacitor 442 form a filter to delay the reset pulse to ensure that the final value of the counter is latched before the display counter is cleared. IC424 is cleared when the counter of frequency divider 80 reaches a count of 2.

The "power-on clear" pulse to the input of IC422 ensures that IC422 is cleared when power is first turned on and no tachometer pulses are present. Thus, no latch-up condition can occur upon powering up. Monostable multivibrator 426 and transistor 430 together with the associated components as shown form a re-triggerable monostable multivibrator which is continuously retriggered when the motor 58 is turning and tachometer pulses are present. Resistor 432 and capacitor 434 form a timing circuit which determine the minimum frequency of pulses from IC424 necessary to maintain monostable multivibrator 426 triggered. Each time the Q output of IC424 goes high, transistor 430 is driven to the "ON", state through base drive current limiting resistor 436. When transistor 430 goes "ON" capacitor 434 is discharged rapidly to nearly zero potential, and the trigger input of oscillator 426 goes low, triggering the monostable multivibrator for a new timing cycle. When the Q output of IC424 goes low, capacitor 434 begins to charge through timing resistor 432. If the pulses from IC424 occur at a sufficient rate, the voltage across capacitor 434 never reaches the threshold level of monostable multivibrator 426 as detected at its threshold input, and the output of monostable multivibrator 426 remains high. However, if the tachometer pulses should cease, IC424 will remain in the clear state, and the output of monostable multivibrator 426 will go low once the threshold voltage across capacitor 434 is reached. When monostable multivibrator 426 goes low, the output of gate 428 goes high, holding a reset on the display counter of circuit 84. If the reset were absent, the display would read the last count value before tachometer pulses ceased, and a non-zero value would be displayed when the motor 58 was stopped. Capacitor 438 functions as a filter capacitor to filter the control input voltage to oscillator 426, preventing false triggering and instability. Note that the counter of frequency divider 80 is cleared synchronously with a tachometer pulse, and all timing begins synchronously with the next tachometer pulse. This scheme eliminates the least significant digit display instability which could result if the timing for each conversion cycle ran asynchronously with the tachometer pulses.

The output of control logic circuit 74 is appropriately connected to counter, latch, and multiplex circuit 84 as shown, which may be a standard commercially available integrated circuit such as a number 4553. The output of circuit 84 is connected to decoder 86, which may be a standard commercially available circuit such as a BCD to 7 segment decoder such as a number 74C48. Also connected to counter, latch, and multiplex circuit 84 is a digit driver circuit 88.

Digit driver circuit 88 comprises four transistors 480, 482, 484, and 486 connected as shown with a resistor 490 connected between the emitters of transistors 484 and 486. Transistors 480, 482, and 484 form the main digit select drive. Base drive to these transistors is provided by the output of counter, latch and multiplex circuit 84. The base of transistor 486 is connected to monostable multivibrator 426 of control logic circuit 74. The emitters of each of transistors 480, 482 and 484 is connected to a separate integrated circuit comprising digital display 90. The IC's used in digital display 90 may be standard commercially available display circuits such as number 5082-7653. Each of transistors 480, 482 and 484 is driven on sequentially to light either digit 1, 2 or 3 of the display. Transistor 486 is needed to drive the least significant digit on when pulses from tachometer 62 are absent. When the speed of motor 58 is zero, control logic 74 places a continuous clear on the counter/latch/multiplexer circuit 84, which disables the multiplexer. Thus drive to digit 1 must be provided externally if this digit is to remain lighted.

Figure 7:
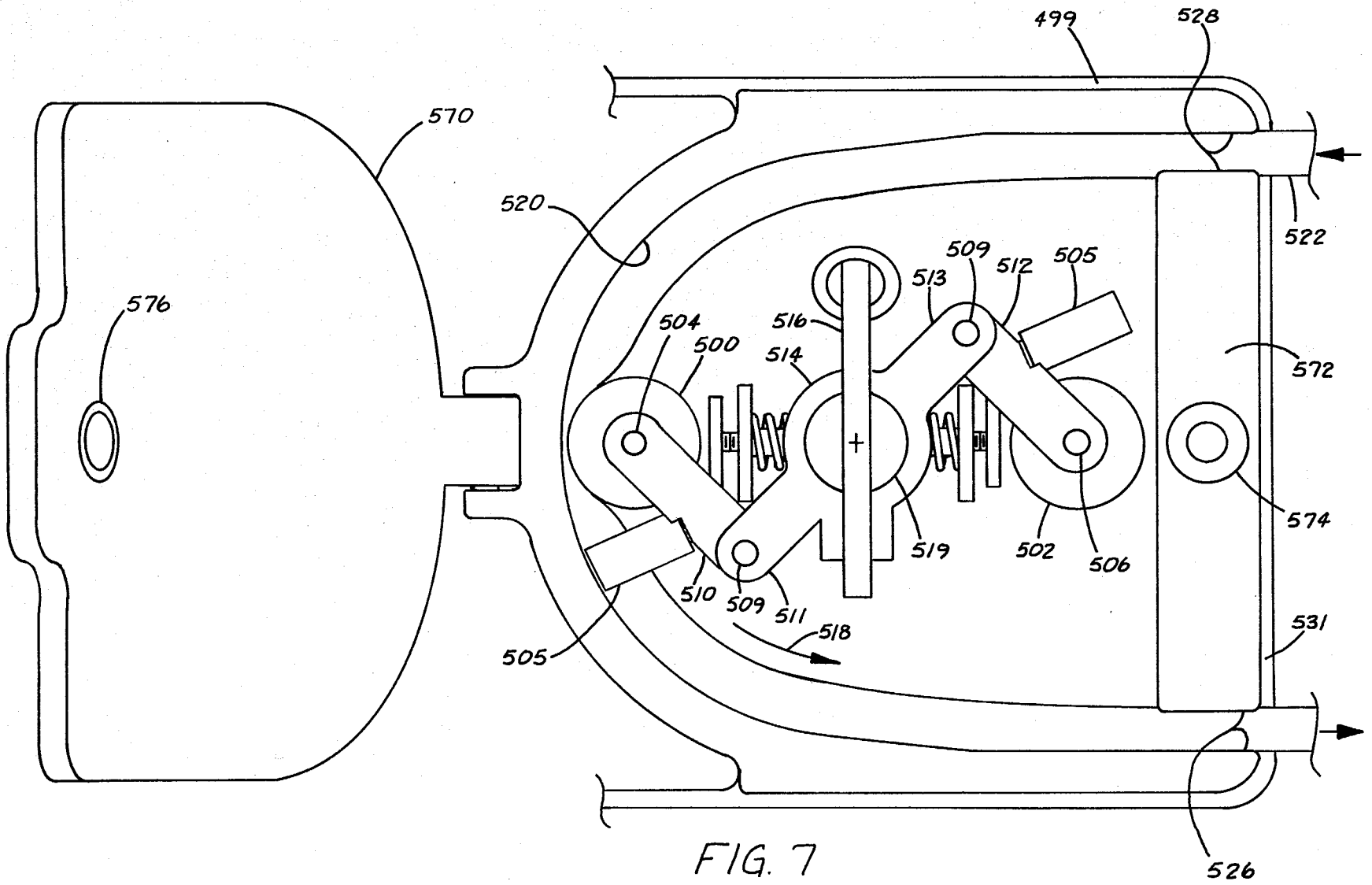
FIG. 7 is a front view of the mechanical portion of the roller pump of the present invention.

FIGS. 7–11 show details pump 59 of the present invention. FIG. 7 shows a rotator head assembly including a housing 499 having a pair of opposed rollers 500 and 502 mounted for rotation about axes defined by pins 504 and 506 which are shown perpendicular to the plane of the drawing. Rollers 500 and 502 are spaced apart 180° and are carried for rotation about axis 508 (shown in FIG. 8) on pivotally-mounted arms 510 and 512 respectively. Arms 510 and 512 are pivoted from extensions 511 and 513 respectively which are integrally formed with a rotator 514 as seen in FIGS. 7 and 9. Arms 510 and 512 pivot about pins 509. Arms 510 and 512 each have extended therefrom guide rollers 505 which are mounted on arms 510 and 512 for rotational purposes as will be explained below. Rotator 514 has a sleeve busing 515 as seen in FIGS. 8 and 9 for allowing easy manual rotation of the rotator head assembly. A handle 516 is hinged to rotator 514, which when in its open position shown in FIG. 9, may be used to manually rotate the rotator head assembly. In its closed position (FIG. 7) handle 516 is folded down in the slotted head of locking screw 519 which locks the rotator head assembly in position so that torque may be transmitted from shaft 517 to the assembly.

Rotator 514 is coupled by a shaft 517 via reduction gears to the output shaft (not shown) of motor 58 seen in FIG. 1. Rotary motion to rotator 514 is transmitted from shaft 517 through a three stage gear reduction device located within the portion of the housing labeled 521. The first reduction is achieved through the mating of a steel helical pinion and a thermoplastic helical gear. The second reduction is from a steel spur pinion to a steel spur gear. The third reduction is from a steel spur pinion to a steel spur gear. This last spur gear is rigidly fixed to shaft 517. The details of these gears are not shown but are contained within the portion of the housing labeled 521.

As rotator 514 rotates about axis 508 by the rotation of shaft 517, arms 510 and 512 and rollers 500 and 502 travel around a circular path indicated by arrow 518. The axes defined by pins 504 and 506 of rollers 500 and 502 respectively move along a circular path concentric with a bearing surface 520.

A flexible tube 522 for carrying blood from a patient is provided so as to be carried by arcuate bearing surface 520. As extensions 511 and 513 and their respective arms 510 and 512 rotate around axis 508, the tube 522 is squeezed against bearing surface 520 by either of the two rollers 500 and 502, thereby rotating the roller about the axis defined by pins 504 and 506 respectively, to pump blood in and out of the tube in the direction of the arrows shown in FIG. 7. Guide rollers 505 hold tube 522 down in proper position as tube 522 is occluded by rollers 500 and 502. Guide rollers 505 are positioned radially about the axis 508. By positioning guide rollers 505 in this way possible damage to tube 522 is avoided. In prior art pumps such guide rollers do not have axes of rotation which pass through the axis of rotation of the rotator head assembly, thereby creating a greater possibility of tearing the tube as the unit rotates. Tube 522 is secured in position by frictionally fitting in slots 526 and 528 which are integrally formed of the same piece of material of which the arcuate bearing surface 520 is formed. By providing these slots it is unnecessary to provide spring-loaded clamps for holding tube 522, which clamps are subject to wear and tear and breakage. In addition, adjacent slots 526 and 528 are two cut out portions 525 which are formed in the side face 531 of the housing 499 as seen in FIG. 8. Typically the ends of tube 522 are connected to additional tubing by end caps (not shown). Cut out portions 525 serve as a means for locking the end caps in position so that when connected to tube 522, tube 522 cannot come out of slots 526 and 528. The side face 531 of housing 499 also has openings 527 which serve as clean out openings to clean any debris from the inside of the area defined by bearing surface 520.

Figure 10:
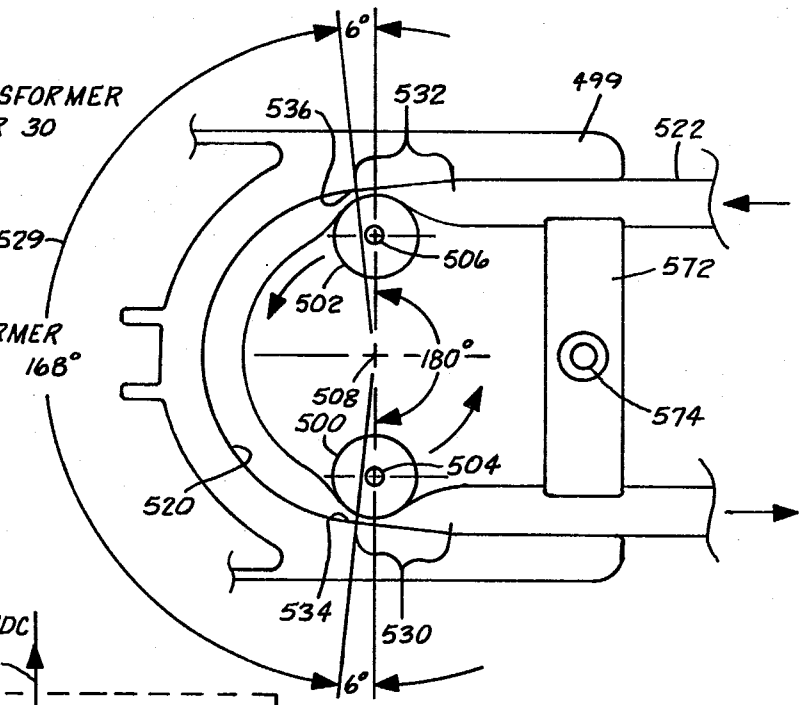
FIG. 10 is a schematic diagram showing the critical dimensions and relationships of the pump of the present invention.

FIG. 10 is a schematic top view showing roller 502 as it begins to squeeze flexible tube 522 against bearing surface 520 and roller 500 as it begins to disengage from flexible tube 522. This is the point at which roller pumps of the prior art required the peak torque to keep the pump operating smoothly. In this invention, it has been found that the optimal angular length defined by bearing surface 520 is an arc 529 of approximately 168°. This arc of 168° allows for the the optimal peak reduction in torque necessary for driving the rotator head assembly. The axes defined by pins 504 and 506 of roller 500 and 502 respectively are spaced 180° apart. Coupled with this arc 529 of 168°, lead ramps 530 and 532 (shown with brackets to illustrate their length) are provided at each end of the arcuate portion of bearing surface 520, with lead ramp 530 starting at point 534 and lead ramp 532 starting at point 536. Ramp 530 is perfectly tangent to surface 520 at the exact point 534 and ramp 532 is perfectly tangent to surface 520 at the exact point 536 of the circular arc defined by surface 520. Thus there is a perfectly smooth transition from surface 520 to lead ramps 530 and 532.

The effect of lead ramps 530 and 532 is to provide for optimal disengagement of roller 500 to begin as roller 502 begins to squeeze flexible tube 522. "Disengagement" as used herein means reduction of occlusion of tube 522 by a given roller. During operation of the pump, it is necessary that flexible tube 30 be sufficiently occluded to prevent a backflow of blood through the pump. Rollers 500 and 502 in the position shown in FIG. 10 must together provide sufficient occlusion of flexible tube 522 to prevent backflow while lead ramps 530 and 532 together with arc 529 defined by surface 520 provide the optimal peak torque reduction required to drive the pump through the position shown in FIG. 10. In addition the ramps by being tangent provide the optimal graduated change in cross-section of the bore of tube 522 as the rollers approach and recede from the point of occlusion. This optimal graduated change in cross-section of the bore of tube 522 helps reduce the peak torque required, puts less stress and wear and tear on tube 522, allows for a more uniform torque demand upon the driving motor 58, which facilitates the use of a smaller motor than would be necessary otherwise, and is physiologically more desirable for the patient whose blood is being pumped.

Since the size of tube 522 can vary slightly and since it is not desirable to fully occlude a tube because the blood cells are crushed, it is important to have precise and accurate means for adjusting the force applied by the rollers, which in turn determines the extent to which a given tube is occluded. FIGS. 9 and 11 show in detail the mechanism which is used to adjust each of the rollers 500 and 502. It should be noted that each roller may be independently adjusted as necessary. This feature is significant because it allows each roller to have independent radial deflection to provide proper occlusion of tube 522 despite irregularities in tube 522.

The roller adjusting mechanism for each roller is radially oriented about axis 508 and includes the following elements. Arms 510 and 512 have support extensions 540 and 542 projecting therefrom respectively. Secured against rotation and extending through each support extension 540 and 542 is a threaded member 544 and 546 respectively onto which are threaded thumb wheels 548 and 550 respectively having knurled outer surfaces to facilitate their rotation. Each of thumb wheels 548 and 550 has an internally threaded neck portion (shown for thumb wheel 548 as 552 in FIG. 11) which is threaded onto threaded members 544 and 546 respectively. Each thumb wheel 548 and 550 is provided with a counterbore in the face of rotator 514 which for thumb wheel 548 is shown in FIG. 11 to be counterbore 554. Corresponding to each of these counterbores is a counterbore in the face of rotator 514 which for thumb wheel 548 is shown in FIG. 11 to be counterbore 556.

Positioned between counterbore 554 and 556 is a compression spring 558 which is shown in partially compressed state. Thumb wheel 550 has a corresponding spring 560. Each thumb wheel 548 and 550 has an elastic sleeve 562 and 564 respectively, located concentrically within respective spring 558 and 560 and which fits around and is supported by the corresponding neck portion which for thumb wheel 548 is neck portion 552. In partially compressed state as shown in FIG. 11, sleeve 562 is longer than neck portion 552 and spring 558 is longer than sleeve 562. The same size relationships exist for springs 560, sleeve 564 and the neck portion of thumb wheel 550.

The operation of the roller adjusting mechanism is as follows and will be described in conjunction with the adjustment of roller 500 with thumb wheel 548. Of course, the adjustment of roller 502 using thumb wheel 550 works in exactly the same manner. Slightly compressed with no tightening of thumb wheel 548, spring 558 is seated at one end in counterbore 554 and at the other end is seated in counterbore 556. The free height of spring 558 and the space in which it is retained is selected so that very little force is applied to roller 500. As thumb wheel 548 is tightened, greater force is exerted on roller 500 by spring 558. As tightening continues sleeve 562 comes in contact with counterbore 556 in rotator 514. As tightening of thumb wheel 548 continues, roller 500 is loaded with the combined effort of spring 558 and sleeve 562 in compression. A final point of maximum pressure is reached when the end of neck portion 552 contacts counterbore 556 in rotator 514. This configuration allows a wide range of spring effort available to occlude tube segments of the softest and the hardest durometers. Also, the rate of change of spring effort is gradual for the first few turns of thumb wheel 548, which allows very fine adjustment necessary to occlude soft durometer tubes. Then the rate of change of spring effort becomes greater to allow quicker occlusion adjustment for harder durometer tubes. The end of neck portion 552 prevents further compression of spring 558 and sleeve 562 when it comes in contact with counterbore 556. This prevents spring 558 and sleeve 562 from taking a permanent set since any spring would take a set if compressed beyond a certain point.

Another feature with which the pump is provided is a button (not shown) on the side of the casing which when depressed moves a rod into a groove notched into shaft 517. When the rod is seated in this groove, the rotator head assembly is prevented from rotating. This facilitates unscrewing of the locking screw 519 seated in rotator 514 which permits the entire rotator head assembly to be removed for maintenance and servicing purposes.

As mentioned in the description with respect to the control circuitry, the pump is provided with a cover 570 which is shown partially open in FIG. 7 and closed in FIG. 8. Side face 531 is formed intergral with the material out of which surface 520 is made. Top surfaces 572 of side face 531 has a magnetic closure 574 which cooperates with magnetic closure 576 located on the underside of cover 570. Closure 574 is connected to the interlock circuit 53 shown in FIGS. 1 and 4. When cover 570 is closed magnetic closures 574 and 576 keep the cover in closed position as well as serving as the closed switch 254 in FIG. 4 to allow rotator 514 to be driven by motor 58. When cover 570 is opened, contact is broken between magnetic closures 574 and 576 thereby in effect opening switch 254 of interlock circuite 53 which serves to disable motor 58 and stop further rotation of rotator 514 thereby rendering the pump inoperative. Thus cover 570 and interlock circuit 53 serve as a safety system to stop operation of the pump if cover 570 is opened for any reason.

Although the various features of the invention have been shown with respect to a preferred embodiment of the invention, it will be evident that changes may be made in such details and certain features may be used without departing from the principles of the invention.

We claim:

1. A blood pump system comprising:

a roller pump for pumping blood through a flexible tube;

a low voltage D.C. motor having an output shaft;

an electrical control circuit for applying necessary voltage for driving said motor at a predetermined speed;

gearing means connecting the output shaft of said motor to drive said roller pump;

means coupled to said motor for controlling the speed of said motor;

means connected to said coupled means for determining the blood flow rate being pumped through the tube by said pump;

means for visually displaying a digital readout of said flow rate; wherein said roller pump includes:

an arcuate bearing surface defining an arc of approximately 168° adapted to carry a flexible tube through which blood may pass;

a pair of 180° spaced apart, pivotally mounted rollers whose axes travel along a circular path concentric with said bearing surface whereby said rollers occlude the tube so as to allow blood to be pumped therethrough;

means connected to said gearing means for rotating said rollers around said circular path; and lead ramps extending from each end of said bearing surface, each of said ramps extending substantially tangent to the end of said surface from which said respective ramp extends, said 168° arc and said tangent ramps providing the optimal torque peak reduction for said motor to drive said pump and the optimal graduated change in cross section of the bore of the tube as each of said rollers approach and recede from the points of occlusion of the tube.

2. A blood pump system as set forth in claim 1 further including means for automatically preventing movement of said means for moving said rollers around said circular path thereby permitting safe servicing of said pump.

3. A blood pump system as set forth in claim 1 further comprising guide means located radially with respect to axis of rotation of said rotating means for maintaining the tube in proper position with respect to said bearing surface.

4. A blood pump system as set forth in claim 1 further comprising means located radially with respect to the axis of rotation of said rotating means and independently operable with respect to each of said rollers for independently and precisely varying the extent to which each of said rollers occludes the tube.

5. A blood pump system as set forth in claim 4 wherein said means for varying the extent to which each of said rollers occludes the tube includes means for continuously adjusting the radial deflection of each roller as it occludes the tube so as to provide proper occlusion despite tube irregularities.

6. A blood pump system as set forth in claim 5 wherein said continuously adjusting means allows for varying the rate of change of radial force applied to each of said rollers dependent on the hardness of the tube.

7. A blood pump system as set forth in claim 6 wherein said means for varying the extent to which each of said rollers occludes the tube comprises two separate arms each of said arms carrying one of said rollers said continuously adjusting means comprising a separate thumb wheel threadedly connected to each of said arms, each of said thumb wheels having a neck portion, and a compression spring and an elastic sleeve concentrically located around said neck portion, said spring being spaced from said sleeve and said sleeve being located within said spring and supported by said neck portion.

8. A blood pump system as set forth in claim 7 wherein each of said arms and each of said thumb wheels are provided with groves for properly seating each of said springs are sleeves.

9. A blood pump system as set forth in claim 8 wherein in uncompressed state each of said springs is greater in length than its corresponding sleeve and in uncompressed state each of said sleeves is greater in length than the corresponding neck portion of said respective thumb wheel.

10. A blood pump system as set forth in claim 9 wherein tightening of a thumb wheel will first begin to compress said respective spring and as tightening continues compression of said sleeve begins whereby the rate of change of force applied to said respective roller increases with increasing tube hardness.

11. A blood pump system comprising:

a roller pump for pumping blood through a flexible tube;

a low voltage D.C. motor having an output shaft;

an electrical control circuit for applying necessary voltage for driving said motor at a predetermined speed;

gearing means connecting the output shaft of said motor to drive said roller pump;

means coupled to said motor for controlling the speed of said motor;

means connected to said coupled means for determining the blood flow rate being pumped through the tube by said pump; and means for visually displaying a digital readout of said flow rate; wherein said electrical control system comprises:

rectifier means for rectifying an incoming A.C. line voltage to a D.C. voltage;

means electrically connected to said rectifier means for transforming the D.C. voltage to provide a series of relatively low voltage pulses;

means electrically connected to said transforming means for controlling said transforming means to maintain the D.C. voltage output from said transforming means below a predetermined voltage level; and means electrically connected to the output of said transforming means for controlling the input of said output pulses from said transforming means to said motor.

12. A blood pump system as set forth in claim 11 wherein:

said transforming means is an isolation transformer, thereby providing low leakage currents to reduce the potential shock hazard for a patient.

13. A blood pump system as set forth in claim 11 further including:

means electrically connected to the output of said rectifier means for protecting the system from surge currents when the A.C. line current is supplied to said rectifier means.

14. A blood pump system as set forth in claim 11 further including:

Optically-coupled isolator means electrically connected to said transforming means for isolating the A.C. line voltage on the input side of said transforming means.

15. A blood pump system as set forth in claim 11 wherein:

said transforming means includes a pulse width modulator for providing a pulsed output from said transforming means.

16. A blood pump system as set forth in claim 11 wherein said speed controlling means comprises:

means coupled to said motor for determing a frequency representative of the rotational output speed of said motor;

means electrically connected to said frequency determining means for converting the output of said frequency determining means from frequency to voltage; and means for generating an error signal representing the difference between the voltage representing the speed at which said motor is set and the output voltage of said converting means, said error signal being connected to said input controlling means to control the duty cycle of the pulses supplied to said motor thereby determining the speed to the motor.

17. A blood pump system as set forth in claim 16 wherein said error signal generating means includes:

a motor speed control potentiometer, and an error amplifier for comparing the output of said motor speed control potentiometer and the output of said converting means, the output of said amplifier being supplied to said motor input controlling means.

18. A blood pump system as set forth in claim 16 wherein said motor input controlling means includes:

a motor voltage and current sensing circuit;

a motor driving circuit to which said output of said transforming means is electrically connected; and a pulse width modulator electrically connected to the output of said error signal generating means for controlling the duty cycle of pulses supplied to said motor driving circuit.

19. A improved control system for driving a blood pump comprising:

rectifier means for rectifying an incoming A.C. line voltage to a D.C. voltage;

means electrically connected to said rectifier means for transforming the D.C. voltage to provide a series of relatively low voltage pulses;

means electrically connected to said transforming means for controlling said transforming means to maintain the D.C. voltage output from said transforming means below a predetermined voltage level:

a D.C. motor for providing the necessary torque to drive a blood pump;

means electrically connected to the output of said transforming means for controlling the input of said output pulses from said transforming means to said motor;

means coupled to said motor for determing a frequency representative of the rotational output speed of said motor;

means electrically connected to said frequency determining means for converting the output of said frequency determining means from frequency to voltage;

means for generating an error signal representing the difference between the voltage representing the speed at which said motor is set and the output voltage of said converting means, said error signal being connected to said input controlling means to control the duty cycle of the pulses supplied to said motor thereby determining the speed of the motor;

means coupled to said frequency determining means for determining the blood flow rate through said blood pump which is a constant of proportionality times the rotational speed of said motor; and means for visually displaying a digital readout of said flow rate.

20. A control system as set forth in claim 19 further including:

means electrically connected to the output of said rectifier means for protecting the system from sorge currents when the A.C. line current is supplied to said rectifier means.

21. A control system as set forth in claim 19 wherein:

said transforming means includes a pulse width modulator for providing a pulsed output from said transforming means.

22. A control system as set forth in claim 19 wherein said error signal generating means includes:

a motor speed control potentiometer; and an error amplifier for comparing the output of said motor speed control potentiometer and the output of said converting means, the output of said amplifier being supplied to said motor input controlling means.

23. A control system as set forth in claim 19 further including:

electronic latching means electrically connected to said motor for protecting against motor overload and motor runaway, by disabling said motor when motor current and voltage exceed preset levels respectively.

24. A control system as set forth in claim 23 wherein:

said motor input controlling means includes;

a motor voltage and current sensing circuit;

a motor driving circuit to which said output of said transforming means is electrically connected; and a pulse width modulator electrically connected to to the output of said error signal generating means for controlling the duty cycle of pulses supplied to said motor driving circuit; and said latching means is electrically connected between said sensing circuit and said modulator.

25. A control system as set forth in claim 19 wherein:

said transforming means is an isolation transformer; and said motor is a low voltage motor, thereby providing low leakage currents to reduce the potential shock hazard for a patient.

26. A control system as set forth in claim 25 further including:

optically - coupled isolator means electrically connected to said transforming means for isolating the A.C. line voltage on the input side of said transforming means.

27. A blood pump system comprising:

a roller pump for pumping blood through a flexible tube;

a low voltage D.C. motor having an output shaft;

an electrical control circuit for applying necessary voltage for driving said motor at a predetermined speed;

gearing means connecting the output shaft of said motor to drive said roller pump;

means coupled to said motor for controlling the speed of said motor;

means connected to said coupled means for determining the blood flow rate being pumped through the tube by said pump;

means for visually displaying a digital readout of said flow rate; and resettable electronic latching means electrically connected to said motor and responsive to motor current and voltage signals for protecting against motor overload and motor runaway by disabling said motor when motor current or voltage exceed preset levels, respectively.

* * * * *